US007155933B2

(12) United States Patent
Pourmehdi

(10) Patent No.: US 7,155,933 B2
(45) Date of Patent: Jan. 2, 2007

(54) JEWELRY WITH A ROTATABLE MESSAGE DISK

(76) Inventor: Moustafa Pourmehdi, 70 Over Look Ter., Roslyn Hights, NY (US) 11577

( * ) Notice: Subject to any disclaimer, the term of this patent is extended or adjusted under 35 U.S.C. 154(b) by 0 days.

(21) Appl. No.: 10/662,048

(22) Filed: Sep. 11, 2003

(65) Prior Publication Data

US 2005/0056054 A1 Mar. 17, 2005

Related U.S. Application Data

(60) Provisional application No. 60/456,973, filed on Mar. 24, 2003.

(51) Int. Cl.
*A44C 9/00* (2006.01)

(52) U.S. Cl. ..... 63/15; 63/40

(58) Field of Classification Search ..... 63/1.11, 63/1.13, 40, 15, 26
See application file for complete search history.

(56) References Cited

U.S. PATENT DOCUMENTS 1,672,355 A * 6/1928 Ullman ..... 63/1.13
1,792,534 A * 2/1931 Germain ..... 63/15
2,134,586 A 10/1938 Silver
2,182,876 A * 12/1939 Moldenhauer ..... 63/15
2,223,657 A * 12/1940 Baden ..... 63/1.14
3,968,661 A 7/1976 Williams
4,165,574 A 8/1979 Sciotti
D257,018 S * 9/1980 Barr ..... D11/27
4,311,026 A 1/1982 Ochoa
4,525,077 A 6/1985 Ketner
D308,948 S 7/1990 Anderson
4,970,878 A 11/1990 Lee
4,977,757 A * 12/1990 Mesica et al. ..... 63/15
D330,212 S 10/1992 Merritt
5,313,723 A 5/1994 Cregg
5,669,240 A * 9/1997 Lima ..... 63/15
5,987,919 A * 11/1999 Hooser ..... 63/15
6,050,695 A * 4/2000 Fromm ..... 362/104
6,164,815 A 12/2000 Degonda
6,167,726 B1 1/2001 Kremer
6,766,657 B1 7/2004 Chien

* cited by examiner

*Primary Examiner*—William L. Miller
(74) *Attorney, Agent, or Firm*—Sofer & Haroun, LLP

(57) ABSTRACT

The present invention is directed to an item of jewelry comprised of a ring with shank, where the shank defines a disk opening. A message disk is mounted within the disk opening. The message disk is rotatable, transversely to the shank within the disk opening, so as to display an inscription thereon.

7 Claims, 6 Drawing Sheets

JEWELRY WITH A ROTATABLE MESSAGE DISK

RELATED APPLICATIONS

This application relates to and claims priority from, U.S. Provisional Patent Application No. 60/456,973 filed on Mar. 24, 2003, the entirety of which is incorporated herein by reference.

FIELD OF THE INVENTION

The present invention relates to jewelry. More particularly, the present invention relates to an improvement to jewelry allowing for the addition of a movable and rotatable message disk.

BACKGROUND OF THE INVENTION

Various types of jewelry have been used throughout the ages for decorative and celebratory purposes by people throughout the world. All forms of metal, jewels, stones and other valuables have been used to adorn jewelry, adding aesthetic qualities, color and value.

More recently, many forms of jewelry have employed moving parts in order to enhance their value and functionality. The most common use of movable parts typically involves elements of the clasp that connect the ends of the jewelry to one another. Other moving jewelry parts include moveable bands, jewel settings and chain arrangements that allow for flexibility and varied designs.

Another typical feature currently available in the field of jewelry is engraved or printed messages included on the surface of the jewelry. For example, identification engravings and personal messages are typically engraved into wedding bands and bracelets for any number of personal reasons. In addition to, personal messages, engraved or printed messages can include generic statements such as, "friendship, "love," and "forever," decorative designs, and other such inscriptions that may be mass produced for a larger range of consumers.

However, there exists a need to producer high quality jewelry that incorporates the advantages of message inscriptions with moveable parts so as to allow a wearer to alter the displayed message as desired.

SUMMARY

The present invention looks to introduce an new and novel invention into the field of jewelry that provides a rotatable message disk into or near the jewelry setting, capable of displaying a number of different messages.

To this end, the present invention provides for an item of jewelry, comprised of a ring with shank, the shank defining a disk opening. A message disk, is mounted within the disk opening, such that the message disk is rotatable, transversely to the shank, within the disk opening, so as to display an inscription thereon.

BRIEF DESCRIPTION OF THE DRAWINGS

Referring more particularly to the accompanying drawings, which are for illustrative purposes only.

DETAILED DESCRIPTION OF THE PREFERRED EMBODIMENTS

Figure 1A:
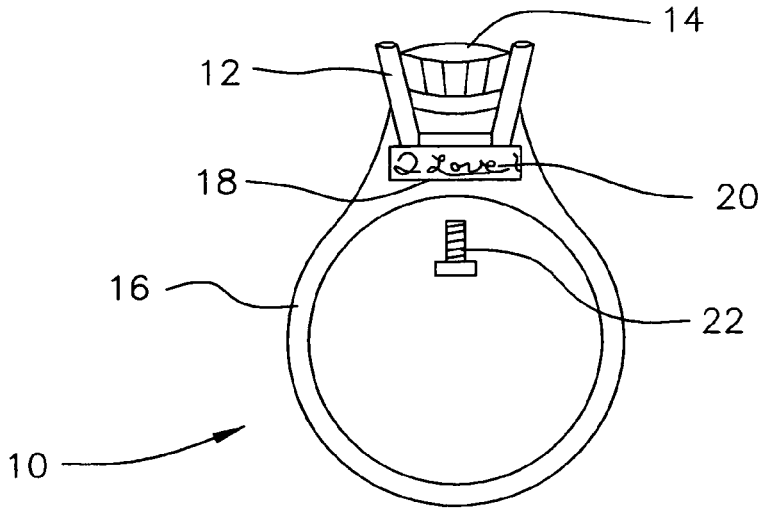
FIG. 1A is side view of a ring with a message disk therein, in accordance with one embodiment of the present invention.
Figure 1B:
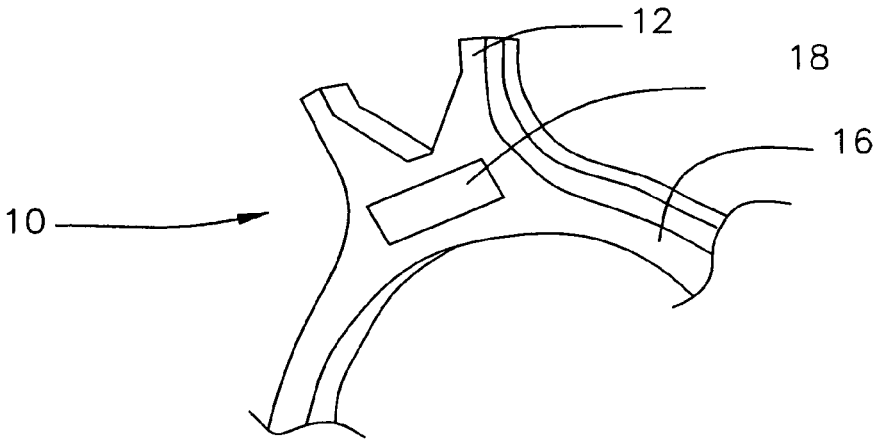
FIG. 1B is side view of a ring of FIG. 1A without the message disk, in accordance with one embodiment of the present invention.

Referring now to the drawings in greater detail, there is illustrated in FIG. 1A, a ring 10, having a series of prongs 12, with a stone 14 set within. As illustrated more clearly in FIG. 1B, the shank 16 of ring 10 is slightly raised near prongs 12 so as to provide a disk opening 18. As shown in FIG. 1A, a message disk 20 is inserted into disk opening 18, and is secured in place by a fixing device 22 such as a sprow, solid pin or screw. It is understood that ring 10 may be constructed from any typical ring, requiring a shank 16 only, however, ring 10, having both a shank 16 and prongs 12, will be used throughout for illustrating the salient features of the present invention.

Message disk 20 may be constructed of metal, such as gold, silver or platinum, and preferably of the same material used for ring 10, however the invention is not limited in this respect. Any substance a designer may use, to create a similar message disk 20 is within the contemplation of the present invention.

Figure 2:
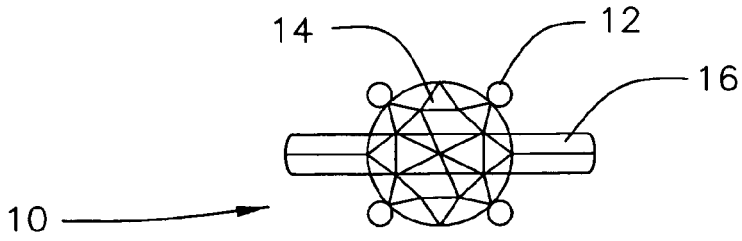
FIG. 2 is a top view of the ring from FIG. 1A, in accordance with one embodiment of the present invention.
Figure 3A:
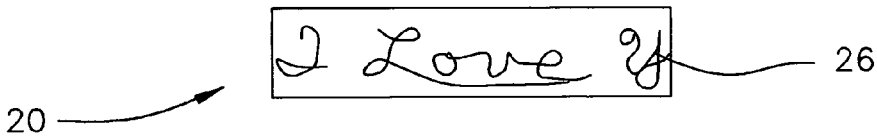
FIG. 3A is a side view of a message disk, in accordance with one embodiment of the present invention.
Figure 3B:
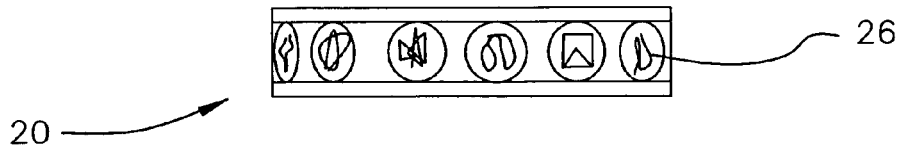
FIG. 3B is a side view of a message disk, in accordance with another embodiment of the present invention.
Figure 3C:
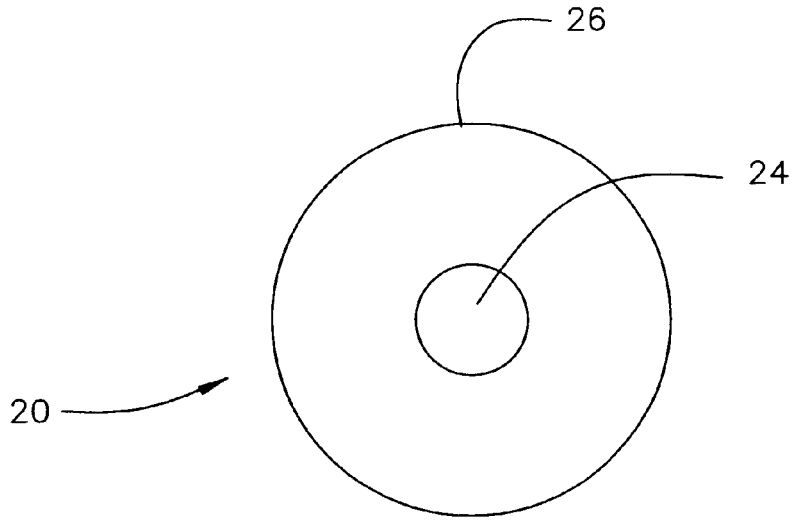
FIG. 3C is a top view of the message disks of either FIGS. 3A or 3B, in accordance with one embodiment of the present invention.

As illustrated in FIGS. 3A–3C, message disk 20 is typically constructed in a cylindrical fashion such that the profile of the cylinder is substantially in proportion to the size of ring 10, or stone 14. For example, as shown in FIGS. 1 and 2, message disk 20 is approximately the same width as stone 14, and, from the top (FIG. 2), is not visible beyond the circumference of stone 14.

As detailed in FIG. 3C, from the top, message disk 20 is preferably constructed in a cylindrical fashion with an opening 24 located in the center used for accepting fixing device 22, for mounting within disk opening 18. A message surface 26 is provided around the outer circumference of disk 20 for displaying text or other decorative elements. However, it is understood that any similar constructed message disk 20, capable of rotation and attachment within disk opening 18 is also within the contemplation of the present invention. For example, message disk 20 may maintain an octagonal message surface 26 so that it may maintain a flush profile with the sides of shank 16 of in ring 10 in its various display positions. As such, any shape message surface 26 for message disk 20 may be used provided it may properly rotate within disk opening 18.

As illustrated in FIG. 3A, message surface 26 of message disk is typically marked or engraved with words, such as "love," "friend," "together;" and so on. In addition to such generic messages, message disk 20 may be engraved or marked with personalized messages regarding anniversaries, birthdays, weddings, and other special events. Alternatively, message surface 26 of message disk 20 may be engraved or marked with illustrations such as those displayed in FIG. 3B. Illustrations, may be of any typical engravings used on jewelry such as Celtic bands, religious insignias, or simply generic drawings. Likewise, the illustrations may be personalized engravings or markings chosen by the wearer. Preferably engravings are placed on message surface 26, via a laser engraving, however any known method of engraving, such as hand engraving, stamped writing or roller engraving may be used.

Once message surface 26 of message disk 20 is posited with the appropriate inscription, it is placed within disk opening 18 of shank 16. Once in place, fixing device 22 is inserted upwardly, into the inside of shank 16 and up through disk opening 18, through opening 24 of message disk 20, then all the way through back to shank 16 again holding message disk 20 in place. In this position, message disk 20 is held in place from falling out of disk opening 18, and is simultaneously allowed to rotate, transversely to shank 16, about the center axis (opening 24), around fixing device 22 so that the desired messages displayed on message surface 26 may be displayed to the wearer, as illustrated in FIG. 1A.

It is understood that message disk 20 may be able to freely rotate about fixing device 22 or, alternatively, it can be set for a ratcheting motion so that desired message is biased to stay visible, directed to the sides of shank 16, until the wearer actively rotates message disk 20 to a different desired message.

Furthermore, it is noted that fixing device 22, may be used for either permanent or temporary attachment of message disk 20 into disk opening 18 of shank 16. For example, in one embodiment of the present invention, ring 10 may be purchased having a single message disk therein, permanently attached to shank 16 by fixing device 22. Alternatively, in another embodiment, ring 10 may be sold with a plurality of message disks 20, each maintaining different inscriptions, such that user can remove one message disk 20 by removing fixing device 22 and replacing message disks 20 as desired, replacing fixing device 22 for securing new message disk 20. In yet another alternative arrangement, multiple message disks 20, may be utilized on top of one another within a single disk opening 18. In such an arrangement, multiple message disks may be either independent of one another or may be utilized so as display complimentary words, phrases or designs.

Figure 4A:
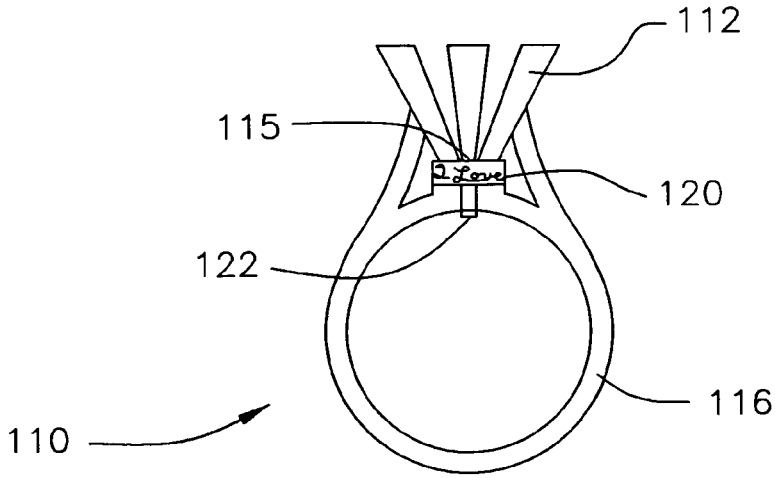
FIG. 4A is a side view of a ring with a message disk therein, in accordance with one embodiment of the present invention.
Figure 4B:
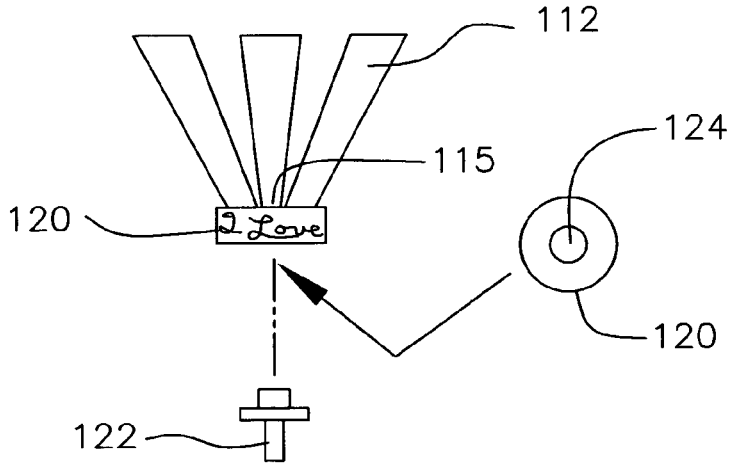
FIG. 4B is an expanded view of a disassembled ring and message disk from FIG. 4, in accordance with one embodiment of the present invention.
Figure 5:
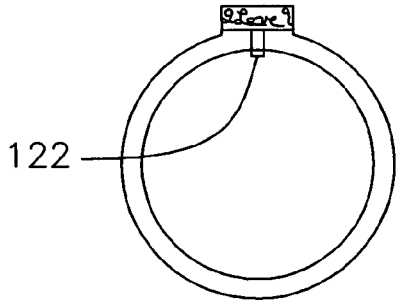
FIG. 5, is a side view of a ring with a message disk thereon, in accordance with one embodiment of the present invention.

Turning to FIG. 4A, in another embodiment of the present invention a ring 110 is provided having prongs 112 and a shank 116. As illustrated, a message disk 120, such as those in FIGS. 3A–3C, are attached directly to the top of shank 116 below the center of prongs 112. As shown in FIG. 4B, prongs 116, forming setting 115, act as the upper mount for message disk 120. In such an arrangement, a fixing device 122, such as screw, sprow or solid pin, is inserted entirely through shank 116, into an opening 124 of message disk 120, and through to the under side of setting 115. This configuration holds message disk 120 between the top of shank 116 and the bottom of setting 115, allowing it to rotate to display the desired message. In an alternative arrangement, as illustrate in FIG. 5, a ring 110 is displayed having only a message disk 120, disposed on shank 116 for transverse rotation, held in place by fixing device 122.

Figure 6:
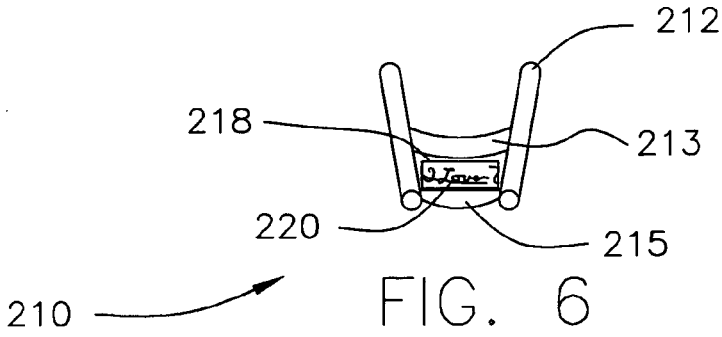
FIG. 6 is a side view of a pendant with a message disk therein, in accordance with one embodiment of the present invention.

In another embodiment of the present invention, as illustrated in FIG. 6, a pendant 210 is provided, having prongs 212, an upper circumferential support ring 213 and a lower circumferential support ring 215. Between upper and lower support rings 213 and 215 is a disk opening 218 for maintaining a rotating message disk 220, such as those described above with respect to the previous embodiments.

Figure 7:
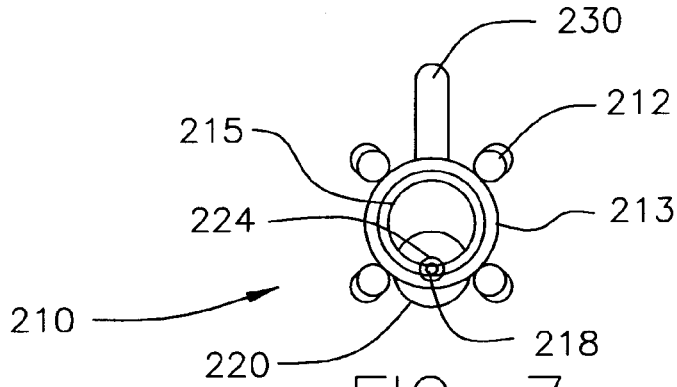
FIG. 7 is a top view of the pendant from FIG. 6, in accordance with one embodiment of the present invention.
Figure 8:
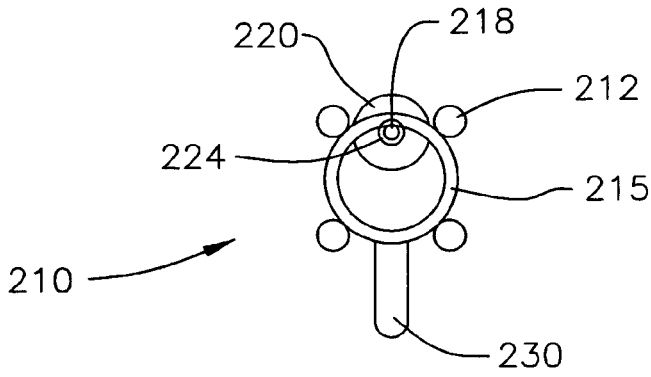
FIG. 8 is a bottom view of the pendant from FIG. 6, in accordance with one embodiment of the present invention.

As illustrated in FIGS. 7 (top) and 8 (bottom), disposed opposite of the pendant bail 230, is a fixing device 218, such as a screw, sprow or solid pin. Fixing device 218 is moved upwardly from bottom support ring 215 through an opening 224 of message disk 220 an into upper supporting ring 215. In this arrangement, message disk 220 is able to move about its center opening 224 displaying the desired messages thereon in a in a visible position, opposite bail 230.

Figure 9A:
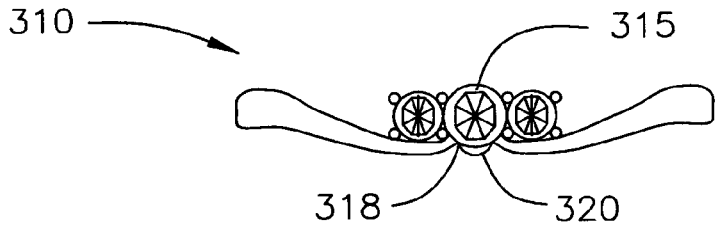
FIG. 9A is top view of a bangle with a message disk therein, in accordance with one embodiment of the present invention.
Figure 9B:
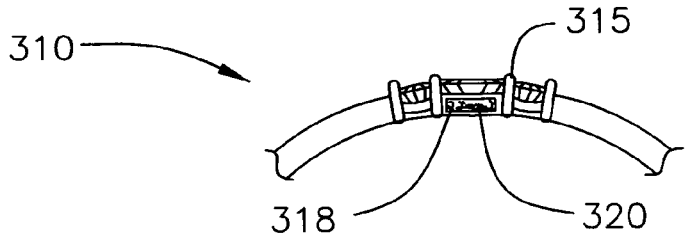
FIG. 9B is a side view of the bangle from FIG. 9A, in accordance with one embodiment of the present invention.

As illustrated in FIGS. 9A and 9B, in another embodiment, a bangle 310 is provided, having settings 315. In or around settings 315 is a disk opening 318. Within disk opening 318 is a message disk 320, such as those described above with respect to the previous embodiments. In such an arrangement, message disk 320 can be placed in or around the stone setting 315 or, alternatively they can be placed directly into the metal itself, anywhere along bangle 310.

Figure 10A:
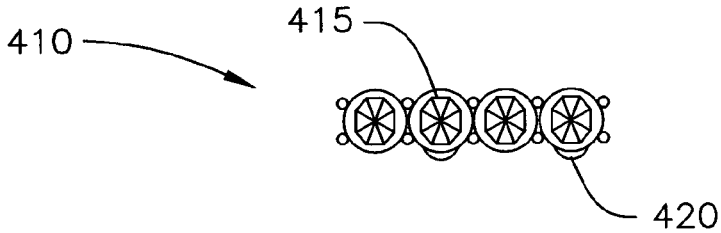
FIG. 10A is top view of a bracelet portion with a message disk therein, in accordance with one embodiment of the present invention.
Figure 10B:
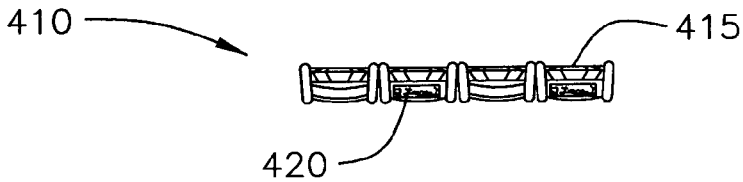
FIG. 10B is a side view of the bracelet portion from FIG. 10A, in accordance with one embodiment of the present invention.

In another embodiment of the present invention, as illustrated in FIGS. 10A and 10B, a bracelet 410 is provided, having a series of settings 415, along its length. A message disk 420 is proved in one or more of the setting 415 so as to provide for a series of message along the length of the bracelet.

Figure 11A:
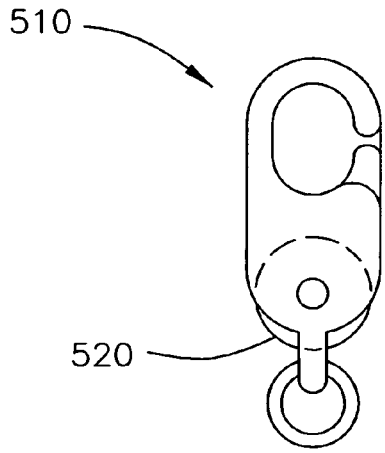
FIG. 11A is a front view of a clasp with a message disk therein, in accordance with one embodiment of the present invention.
Figure 11B:
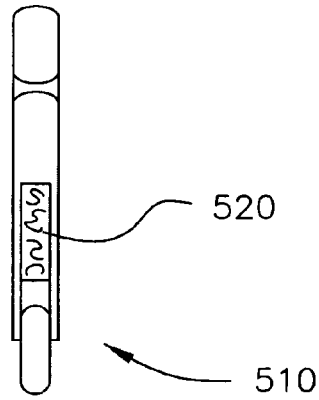
FIG. 11B is a side view of the clasp from FIG. 11A, in accordance with one embodiment of the present invention.

Turning to FIGS. 11A and 11B, a clasp 510 is provided having a message disk 520 therein, similar to the messages disks described above in FIGS. 3A–3C. It is noted that although FIGS. 11A and 11B, show a lobster claw clasp, it is understood that the use of a similar message disk 520 with any form of clasp, such as spring ring, screw or box catch clasps, are all within the contemplation of the present invention.

Figure 12A:
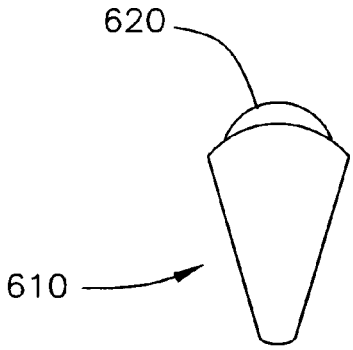
FIG. 12A is a front view of a bail with a message disk therein, in accordance with one embodiment of the present invention.
Figure 12B:
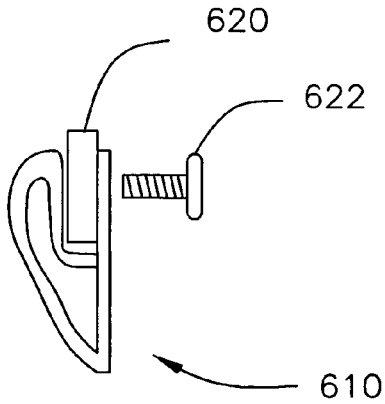
FIG. 12B is a side view of the bail from FIG. 12A, in accordance with one embodiment of the present invention.

In another embodiment, as illustrated in FIGS. 12A and 12B a bail 610 is provided having a message disk 620 therein, similar to the messages disks described above in FIGS. 3A–3C. Message disk 620 is held in place by fixing device 622, allowing message disk 620 to rotate freely.

It is understood that message disks 20, described throughout the application and shown in use with rings, bracelets, bails, clasps and bangles, however, this is in no way intended to limit the scope of the present invention. Any similar application, containing a similar message disk, having a text or pictographic image thereon, in use with any typw of jewelry, is within the contemplation of the present invention.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. An item of jewelry, said jewelry item comprising, a ring with a shank having a thickened upper portion in proximity to prongs for holding a stone or gem above said thickened upper portion of said shank, said thickened upper portion of said shank defining a disk opening extending therehrough, with said disk opening being entirely formed by said thickened upper portion; and a cylindrical message disk having an inscription thereon, mounted within said disk opening, wherein said cylindrical message disk is rotatable, transversely to said shank, within said disk opening, so as to display said inscription thereon, said disk having approximately the same circumference as said stone or gem whereby when viewing said jewelry item from directly above, said disk is not visible beyond the circumference of said stone or gem.

2. The jewelry item as claimed in claim 1, wherein said cylindrical message disk maintains a plurality of inscriptions thereon, said cylindrical message disk rotatable within said disk opening so as to display a desired inscription among a plurality of inscriptions.

3. The jewelry item as claimed in claim 1, wherein said inscription is a textual message.

4. The jewelry item as claimed in claim 1, wherein said inscription is decorative design.

5. The jewelry item as claimed in claim 1, wherein said cylindrical message disk is supported in said disk opening by a fixing device.

6. The jewelry item as claimed in claim 5, wherein said jewelry further comprises a second cylindrical message disk, said message disk, wherein said message disks are interchangeable with one another.

7. The jewelry item as claimed in claim 5, wherein said fixing device is any one of a sprow, solid pin, and screw.

* * * * *